US005195194A

United States Patent [19]

Bradley et al.

[11] Patent Number: 5,195,194

[45] Date of Patent: Mar. 23, 1993

[54] SEAT-BED EXTENDER

[75] Inventors: Thomas C. Bradley; John Shimkus; Fred J. Shrock; Scott J. Shrock, all of Elkhart, Ind.

[73] Assignee: Shrock Manufacturing, Inc., Elkhart, Ind.

[21] Appl. No.: 904,958

[22] Filed: Jun. 26, 1992

[51] Int. Cl.[5] ..... A47C 17/17

[52] U.S. Cl. ..... 5/37.1; 5/39; 5/42.1; 5/47

[58] Field of Search ..... 5/18.1, 37.1, 38, 39, 5/41, 42.1, 47; 297/163

[56] References Cited

U.S. PATENT DOCUMENTS 4,365,369 12/1982 Plume ..... 5/47 X
4,512,048 4/1985 Isham et al. ..... 5/37.1
4,543,675 10/1985 Shrock ..... 5/42.1 X
4,625,346 12/1986 Quakenbush ..... 5/37.1
4,660,235 4/1987 Plume ..... 5/47
4,696,069 9/1987 Crosthwaite ..... 5/42.1
4,750,222 6/1988 Quakenbush ..... 5/37.1
4,939,802 7/1990 Lafer ..... 5/42.1

*Primary Examiner*—Michael F. Trettel
*Attorney, Agent, or Firm*—James D. Hall

[57] ABSTRACT

An improved seat-bed extender assembly for a convertible seat-bed. The assembly includes an attachable platform and corresponding linkage to allow conversion to a full-sized bed in conjunctive relation with a convertible seat and for operation of the platform independently of the seat.

5 Claims, 5 Drawing Sheets

SEAT-BED EXTENDER

FIELD OF THE INVENTION

This invention relates to a convertible seat-bed, and will have special application to an extender for converting the seat-bed into a full size bed.

SUMMARY OF THE INVENTION

The seat-bed extender assembly of this invention is principally adapted for use with convertible seat-bed assemblies in a vehicle such as a camper or van. Heretofore, seat-bed assemblies were convertible from a seating position into a fold out twin or double sized bed. This type of construction is embodied in U.S. Pat. Nos. 4,321,716 and 4,543,675, incorporated herein by reference.

The seat-bed extender assembly of this invention utilizes convertible extension connected to the seat frame of a convertible seat-bed as embodied in U.S. Pat. No. 4,321,716. The extender assembly allows an extended platform to move between a vertical stored position to a horizontal use position. When the seat-bed assembly is in its seat position, the extender assembly can operate independently from the seat-bed to allow its platform to be shifted into its use position. When the seat-bed assembly moves into its horizontal bed position from its seat position, the extender assembly platform moves into its use position. The linkage system of the extender assembly is essentially hidden, allowing unincumbered use of the platform, when the platform is in its use position with the seat-bed assembly in its seat position.

Accordingly, an object of this invention is to provide a novel add-on seat-bed extender assembly.

Another object of this invention is to provide a linkage system which is for a seat-bed assembly and which allows the seat to be converted into a full-size bed.

Another object of this invention is to provide for a seat-bed assembly which has a separately operable extender linkage system.

Other objects of this invention will become apparent upon a reading of the following description.

BRIEF DESCRIPTION OF THE DRAWINGS

A preferred embodiment of the invention has been chosen for purposes of illustration wherein.

DESCRIPTION OF THE PREFERRED EMBODIMENT

Figure 1:
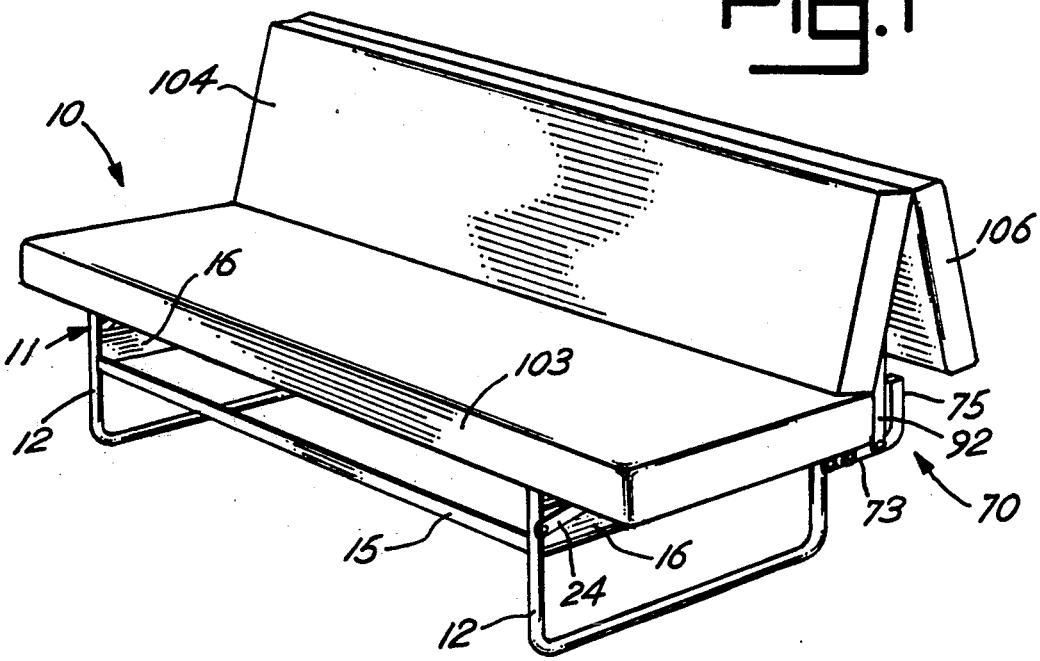
FIG. 1 is a front perspective view of the seat-bed assembly in its seat position and with the extender assembly in its stored position.
Figure 2:
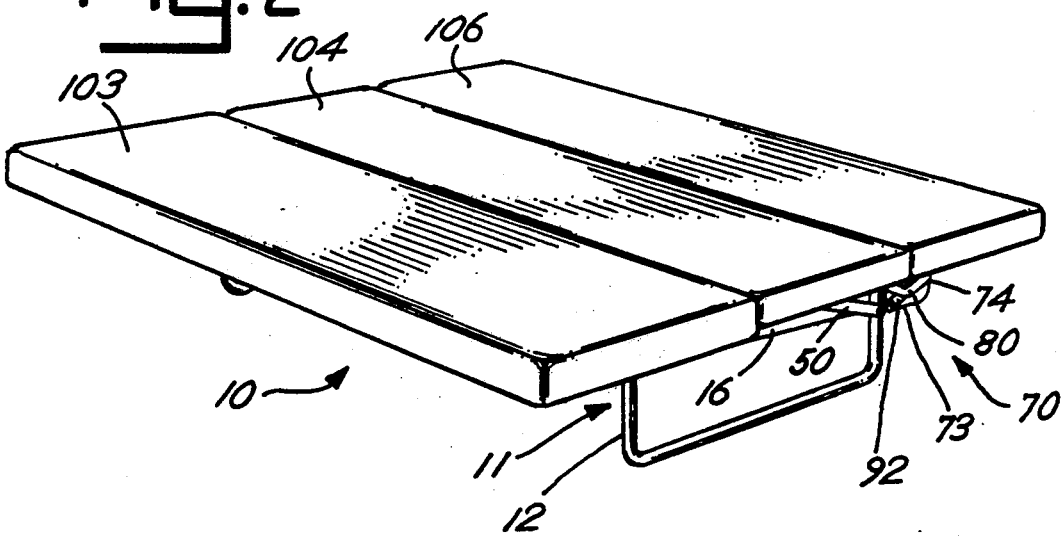
FIG. 2 is a front perspective view of the seat-bed assembly in its bed position and with the extender assembly in its use position.
Figure 3:
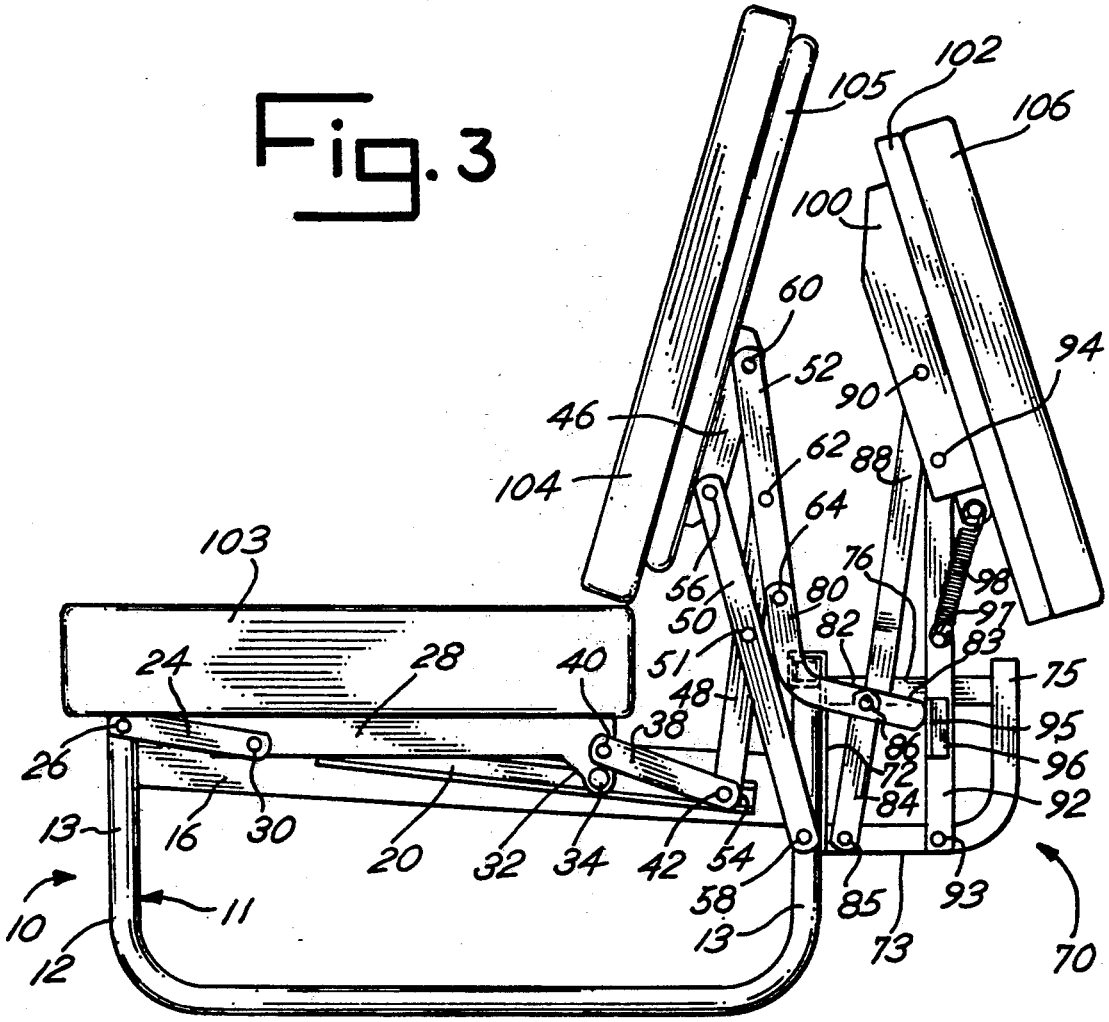
FIG. 3 is a side elevational view of the seat-bed assembly in its seat position and with the extender assembly in its stored position.

The preferred embodiment herein described is not intended to be exhaustive or to limit the invention to the precise form disclosed. It is chosen and described to explain the principles, application and practical use of the invention to thereby enable others skilled in the art to utilize the invention.

The extender assembly 70 and seat-bed assembly 10 of seat-bed 5 shown in the drawings are adapted for use in vans, campers and other recreational vehicles. Both extender assembly 70 and seat-bed assembly 10 have identical linkage constructions on opposed ends of the device. Thus, only one of each linkage construction will be specifically described for each of the seat-bed and extender assemblies with the understanding that a like assembly is located and used at the opposite end of each assembly.

Seat-bed assembly 10 includes a base or support frame 11 formed of spaced U-shaped end members 12. End members 12 are preferably connected by longitudinal cross members 15 which extend the width of the assembly. Each end member 12 includes vertical legs 13 between which a support 16 extends. As shown in FIGS. 3-7, guide channel 20 is carried upon each support 16. The connecting linkage extending from each end member is shown and will now be described.

FIGS. 3-7 show the structure, connection and relation of the various links of seat-bed assembly 10 and extender assembly 70. A link 24 is pivotally connected at 26 to front leg 13 of U-shaped member 12 and is pivotally connected to the front of a seat support 28 at 30. A bench type seat cushion 103 is attached to support 28. A leg 32 extends from the rear of support 28 and is slidably retained at its lower end 34 for movement along guide channel 20 by a roller (not shown) located within the guide channel. A link 38 is pivotally connected at one end 40 to seat support 28 and is slidably retained for movement along guide channel 20 at its other end 42 by another roller (not shown) located within the guide channel.

A lazy tong-like linkage controls movement of a back support 46 and includes links 48, 50 and 52. A back cushion 104 is attached to cushion frame 105 and support 46. One end 54 of link 48 is pivotally connected to end 42 of link 38 for slidable movement along guide channel 20. End 62 of link 48 is pivotally connected to an intermediate part of link 52. Link 52 is pivotally connected at 60 to back support 46 and at its other end 64 to a curved link 80. Link 50 is pivotally connected at one end 56 to back support 46 and at its center 51 to link 48 and is pivotally connected at its other end 58 to rear leg 13 of U-shaped frame member 12. Link 50 is also pivotally connected at 51 to an intermediate part of link 48.

Extender assembly 70 attaches seat-bed assembly 10 along the rear vertical leg 13. Mounting plate 72 of extender assembly 70 is bolted or otherwise connected to cross member 15 along leg 13. A lower horizontal arm 73 extends rearward from the lower portion of mounting plate 72. Horizontal arm 73 has a vertical part 75. An upper horizontal arm 76 extends from the upper portion of mounting plate 72 and connects to arm part 75. Thus, so connected, plate 72, arm 73, and arm 76 become functionally a part of support frame 11.

Figure 5:
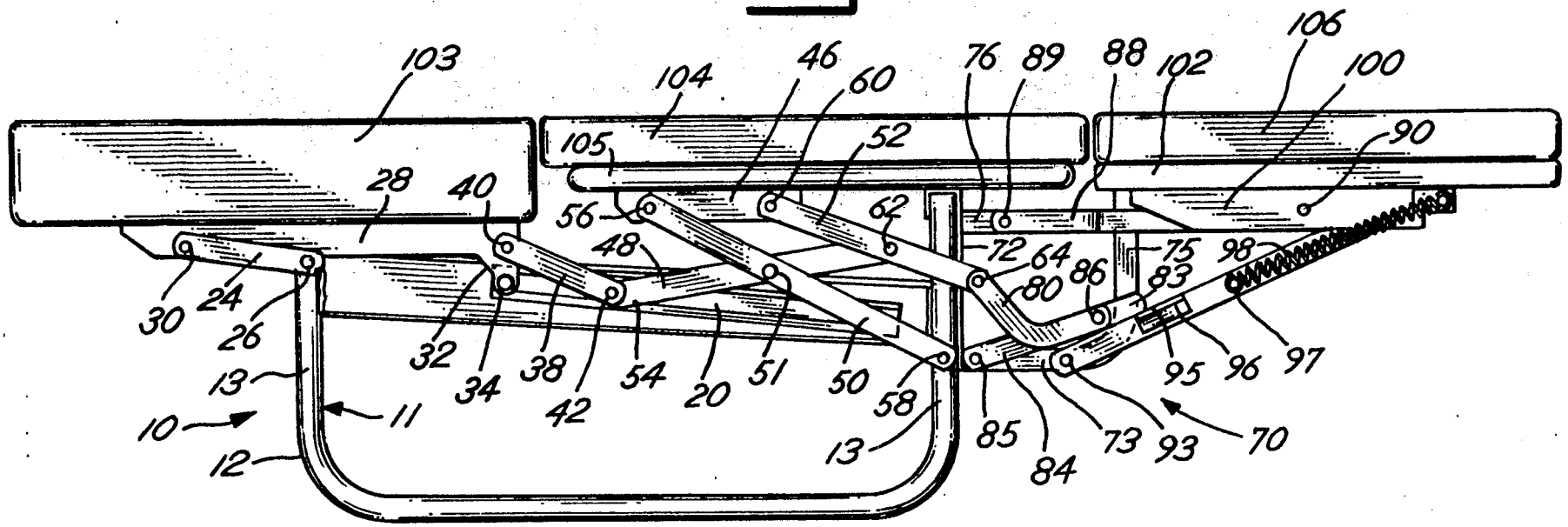
FIG. 5 is a side elevational view of the seat-bed assembly in its bed position and with the extender assembly in its use position.
Figure 6:
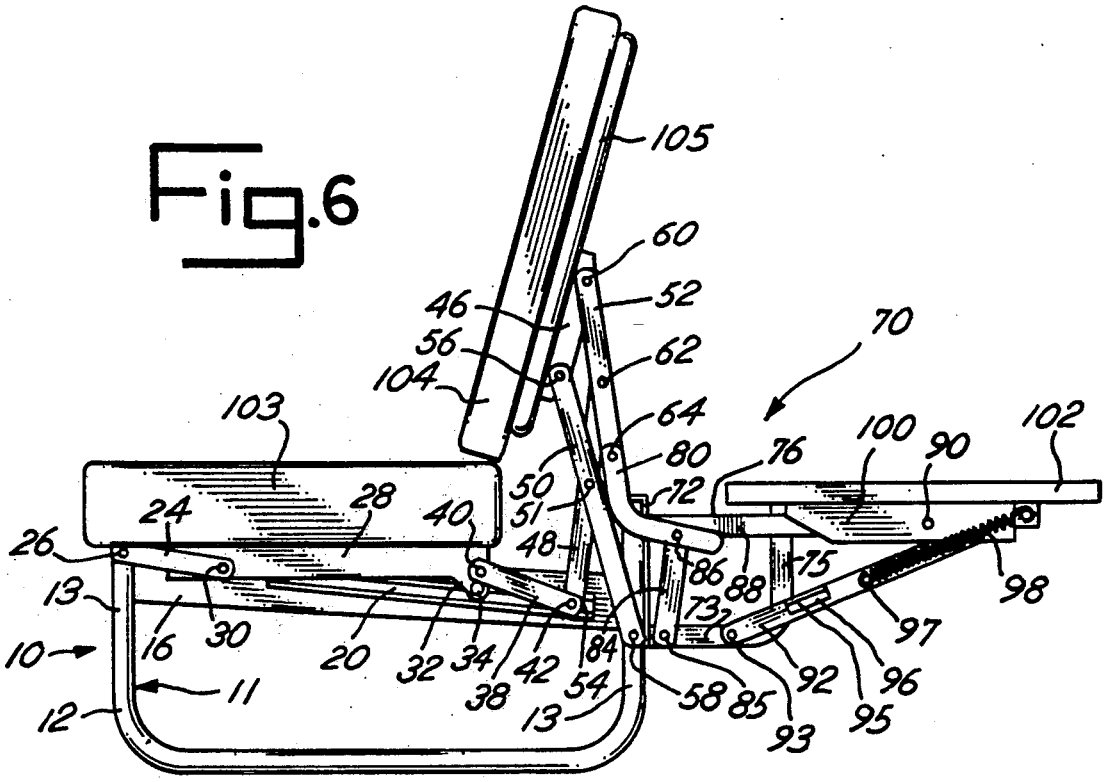
FIG. 6 is a side elevational view of the seat-bed assembly in its seat position and with the extender assembly in its use position.

Links 88 and 92 and extender support 100 carry extender platform 102 and extender cushion 106. Link 88 is pivotally connected at 89 to brace 76 and at 90 to extender platform support 100. Link 92 is pivotally connected at end 93 to horizontal portion 74 of arm 73 and at end 94 to extender platform support 100 at a location rearwardly of link 88. Link 92 has a skid plate 95 secured at an intermediate point 96. A helical spring 98 is pivotally connected at one end to an intermediate point 97 of link 92 and at the other end to the extender support 100 at a point adjacently rearward of connection 94 between link 92 and extender support 100. Extender cushion 106 is preferably removably secured to platform 102 to form a bed when extender assembly 70 is in its use position of FIGS. 2 and 5–7, but can be readily detached when platform 102 is used as a table surface such as seen in FIG. 6.

A curved actuating link 80 connects the linkage of extender assembly 70 to the linkage of seat-bed assembly 10. A link 84 is pivotally connected at end 85 to horizontal arm 73 and at end 86 to an intermediate point 82 along the rearward portion of curved link 80 inwardly from its end 83. Link 80 is pivotally connected to link 52 of seat-bed assembly 10. End 83 of curved link 80 serves as a lever and contacts link 92 along a skid plate 95 secured to the link between its pivot connection 93 and spring 98.

Figure 4:
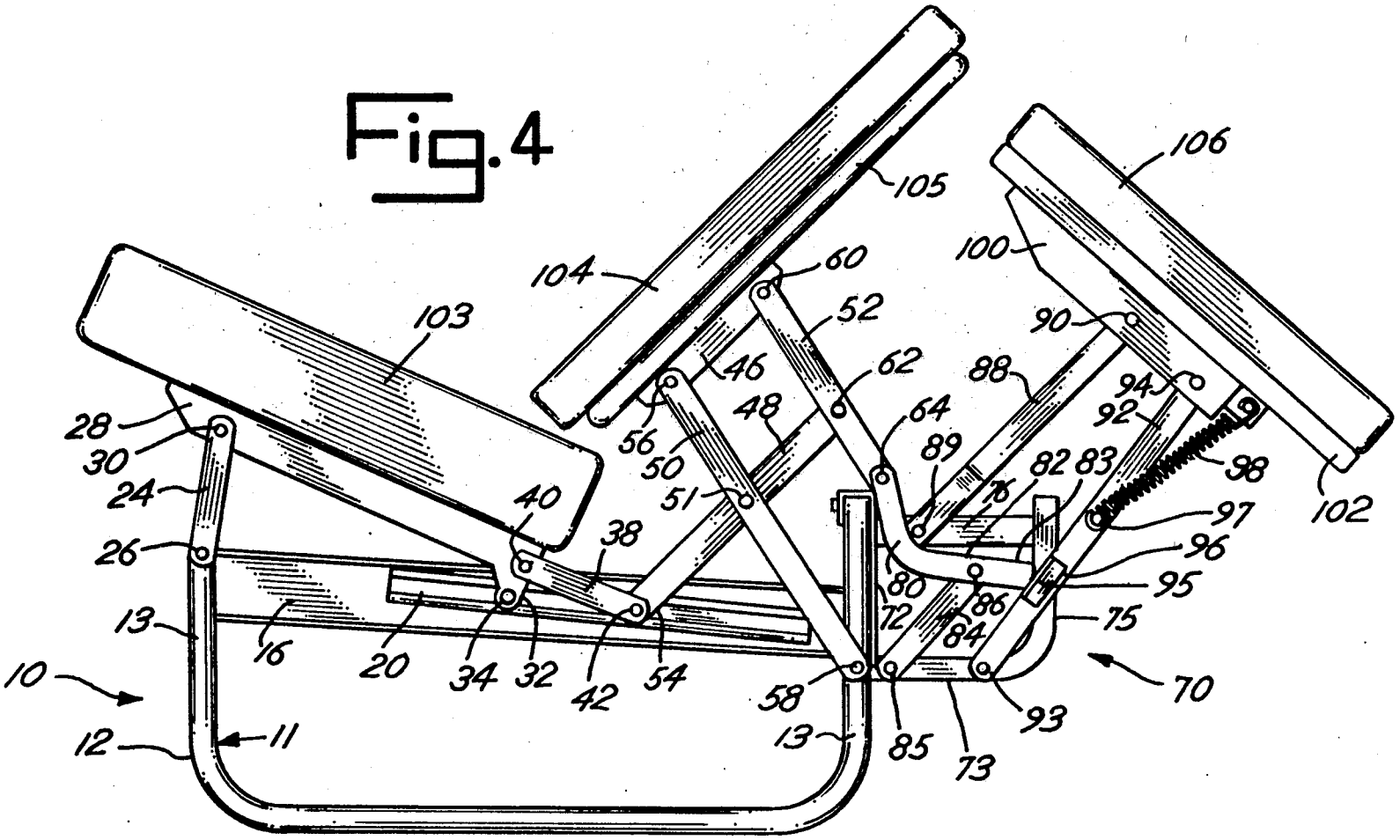
FIG. 4 is a side elevational view of the seat-bed and extender assemblies in an intermediate position.

Seat-bed assembly 10 is operated as follows: In its position of FIG. 3, assembly 10 functions as a conventional seat with extender platform 102 raised. By grasping seat cushion 103 and sliding it outwardly, as seen in FIG. 4, cushions 103 and 104 assume a horizontal aligned orientation, as explained in U.S. Pat. No. 4,321,716, with seat support 28 resting upon end member 12. Simultaneously, the movement of link 52 counter-clockwise, as seen in FIG. 4, urges link end 83 of curved link 80 against skid plate 95 forcing the outward rotation of links 88 and 92. This movement causes extender platform 102 and extender cushion 106 to shift into an aligned horizontal down position as seen in FIG. 5. In this position, cushion 103, 104 and 106 form a flat, full-sized bed. Spring 98 shifts into an overcenter position and holds platform 102 in its horizontal use position. To restore seat-bed assembly 10 to its seat position, seat cushion 103 is pivoted inwardly to bring back cushion 104 upwardly. Extender assembly 70 is then restored to its vertical stored position by grasping and urging platform 102 pivotally upward. Platform 102 preferably cannot be raised with when seat-bed assembly 10 is in its down or bed position to prevent injury to the user.

Figure 7:
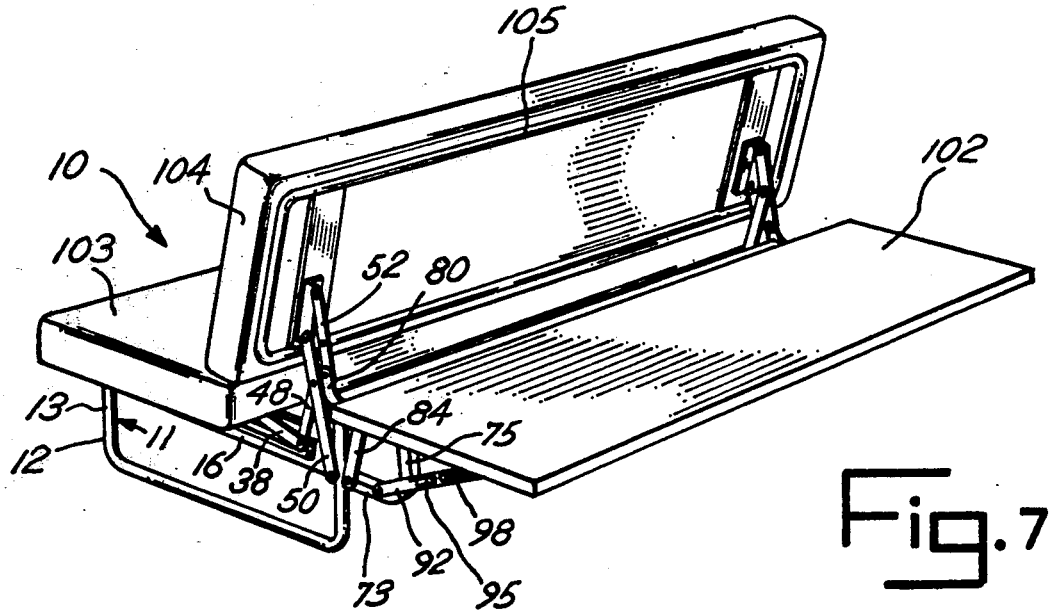
FIG. 7 is a rear perspective view of the seat-bed assembly in its seat position and with the extender assembly in its use position.

With assembly 10 functioning as a conventional seat, extender assembly 70 can operate independently of movement of seat-bed 10. By grasping extender platform 102 and sliding it downward, platform 102 assumes a horizontal aligned orientation supported by vertical leg 75, as seen in FIGS. 6 and 7. Again, spring 98 in its overcenter position holds extender assembly in its horizontal down position. In the horizontal use position, extender platform 102 and extender cushion 106 serves as an addition sitting surface or as a table with cushion 106 removed. To restore extender assembly 70 to its vertical stored position, extender platform 102 is grasped and urged pivotally upward to bring assembly 70 to its vertical position.

It should be noted that bed assembly 10 and extender assembly 70 may be extended either by hand or by mechanized means such as a motor and gear drive, not shown. Also extender assembly 70 can be used as an add-on feature for existing convertible beds.

It is understood that the above description does not limit the invention to the embodiment herein described, but that it may be modified within the scope of the appended claims.

I claim:

1. In combination an extender assembly and a seat-bed, said seat-bed comprising a base frame, a seat support, a back support, and first linkage means connected between said frame and seat and back supports for supporting the seat and back supports for movement between a seat position wherein said seat support is generally horizontal and the back support is generally vertical and a bed position wherein said seat and back supports are horizontal, said extender assembly comprising a platform support, second linkage means connected to said platform support for supporting the platform for movement between a generally vertical stored position and a horizontal use position, and third linkage means associated with said first and second linkage means for causing said platform to move from its stored position into its use position as said seat and back supports move from their seat position into their bed position while allowing movement of the platform between its stored and use positions independently of said seat and back supports.

2. The extender assembly of claim 1 wherein said first linkage means includes three links, a first link of said first linkage means pivotally connected to said frame and said back support, a second of said first linkage means connected to said seat support and said frame, said second linkage means includes two links, a first link of said second linkage means pivotally connected to said frame and said platform support, a second link of said second linkage means connected to said frame and said platform support, said third linkage means connected to said back support and including lever means for disengageable contact with abutting one of said links of the second linkage means to pivotally move the second linkage means and shift said platform support into its use position as said seat and back supports move into their said bed position.

3. The extender assembly of claim 2 wherein said third linkage means includes three links, a first link of said third linkage means including said lever means, a second link of said third linkage means pivotally connected to said last mentioned first link and said frame, a third link of said third linkage means pivotally connected to said back support and said last mentioned first link, said first linkage means including a fourth link pivotally connected to said frame and said last mentioned third link.

4. The extender assembly of claim 1 and biasing means extending between said platform support and a said link of the second linkage means for maintaining said platform support in its said use position and to assist movement of said platform support from its use position into its stored position independently of said first linkage means.

5. The extender assembly of claim 1 wherein said frame includes an attachment part separably securable to the remainder of the frame, said second linkage means carried by said attachment part.

* * * * *